United States Patent [19]

Russell et al.

[11] Patent Number: 4,634,165

[45] Date of Patent: Jan. 6, 1987

[54] FORCEPS HAVING REPLACEABLE TIPS

[76] Inventors: Robert C. Russell, P.O. Box 3926, Springfield, Ill. 62702; David J. Keeler, 152 Valley Rd., Ardmore, Pa. 19003

[21] Appl. No.: 692,377

[22] Filed: Jan. 17, 1985

[51] Int. Cl.[4] ..... B25B 9/02

[52] U.S. Cl. ..... 294/99.2

[58] Field of Search ..... 294/99.1, 99.2; 128/354

[56] References Cited

U.S. PATENT DOCUMENTS 1,284,060 11/1918 Culman ..... 294/99.2
1,832,879 2/1930 Ruskin .
3,280,665 10/1966 Block ..... 294/99.2
3,503,396 3/1970 Pierie et al. .
3,503,397 3/1970 Fogarty et al. .
3,503,398 3/1970 Fogarty et al. .
3,818,784 6/1974 McClure ..... 294/99.2
4,120,302 10/1978 Ziegler .

*Primary Examiner*—James B. Marbert
*Attorney, Agent, or Firm*—Hugh D. Jaeger

[57] ABSTRACT

A forceps having replaceable tips is shown. A handle is provided which releasably receives a small forceps, the small forceps being retained by means of a spring biased tongue which engages an aperture in the small forceps. The handle is longitudinally bifurcated, with each half overlying one of the legs of the small forceps.

2 Claims, 6 Drawing Figures

FORCEPS HAVING REPLACEABLE TIPS

BACKGROUND OF THE INVENTION

1. Field of the Invention

This invention relates generally to forceps having opposable tips and in particular to a forceps wherein the tips are replaceable when worn or damaged.

2. Description of the Related Art

There are many situations where it is necessary to employ finely made hand-held forceps having small, well matching tips. Jewelers have long used such forceps. Many areas of medical practice also require such forceps. In fact, the forceps presently used in microsurgery by ophthalmologists, plastic surgeons, orthopaedic surgeons, and ontolaryngologists have evolved from jeweler's forceps used to repair small watches and other fine jewelry. Other industries which might use this type of forceps are microelectronics and microassembly plants.

Jeweler's forceps are typically made from a single piece of metal, or from two pieces welded together, to form an integrated handle and opposable tips. As used by jewelers, such forceps ordinarily have a long life. However, in surgical use, where the forceps must be repeatedly sterilized and handled by several individuals, the finely made tips are frequently bent or otherwise rendered virtually unusable. Even a small burr or slight discrepancy in opposition of the tips makes the forceps unable to grasp small objects. The frustration and stress caused by forceps which do not oppose correctly can be considerably more serious during surgery than during watch repair. Consequently, there is a great need for a microsurgery forceps in which the the tips can be replaced quickly when damaged, or when a differently configured tip is required.

SUMMARY OF THE INVENTION

One embodiment of a forceps in accordance with the present invention might include forceps tips, wherein the forceps tips include a pair of side by side elongate members. Each elongate member has a first end and a second end, with the first ends of the elongate members being fixed together. The second ends of the elongate members are configured as opposable tips. Also provided is a handle means, having a location to be grasped by a person, for receiving the forceps tips and for causing the second ends of the elongate members of the forceps tips to be forced into opposition with each other in response to manipulation of the graspable location of the handle means. The handle means includes releasable retaining means for releasably retaining the forceps tips.

It is an object of the present invention to provide an improved forceps having tips which can be easily replaced if desired or when damaged.

Further objects and advantages will be apparent from the following description of the preferred embodiment of the invention.

DESCRIPTION OF THE PREFERRED EMBODIMENTS

Figure 1:
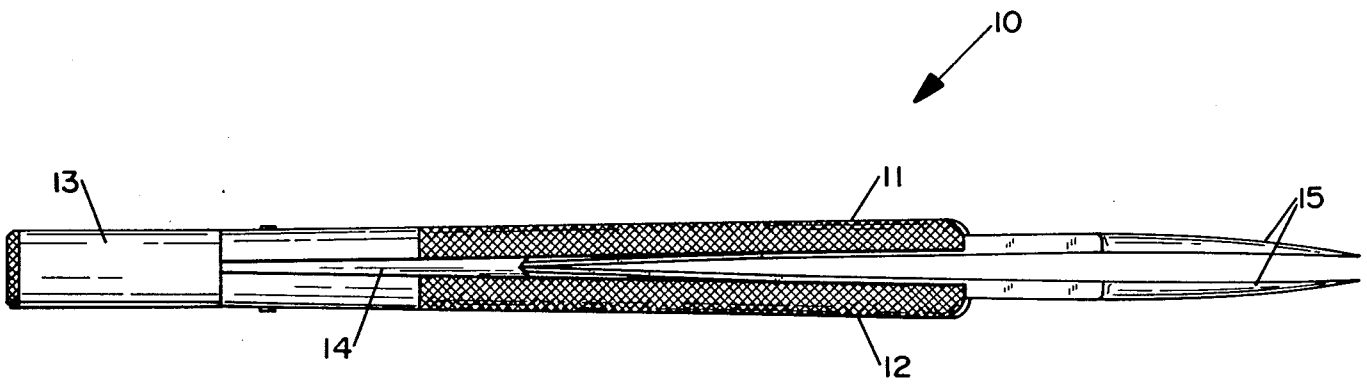
FIG. 1 is an elevational view of a forceps made in accordance with the present invention.

For the purposes of promoting an understanding of the present invention, reference will now be made to the embodiment illustrated in the drawings and specific language will be used to describe the same. It is nevertheless to be understood that no limitation of the scope of the invention is thereby intended, the proper scope of the invention being indicated by the claims appended below and the equivalents thereof.

Referring in particular to FIG. 1, there is illustrated a forceps 10 configured in accordance with the present invention. Forceps 10 includes as its principal components handle portions 11 and 12, cap 13, forceps retainer body 14, and forceps tips 15.

Figure 2:
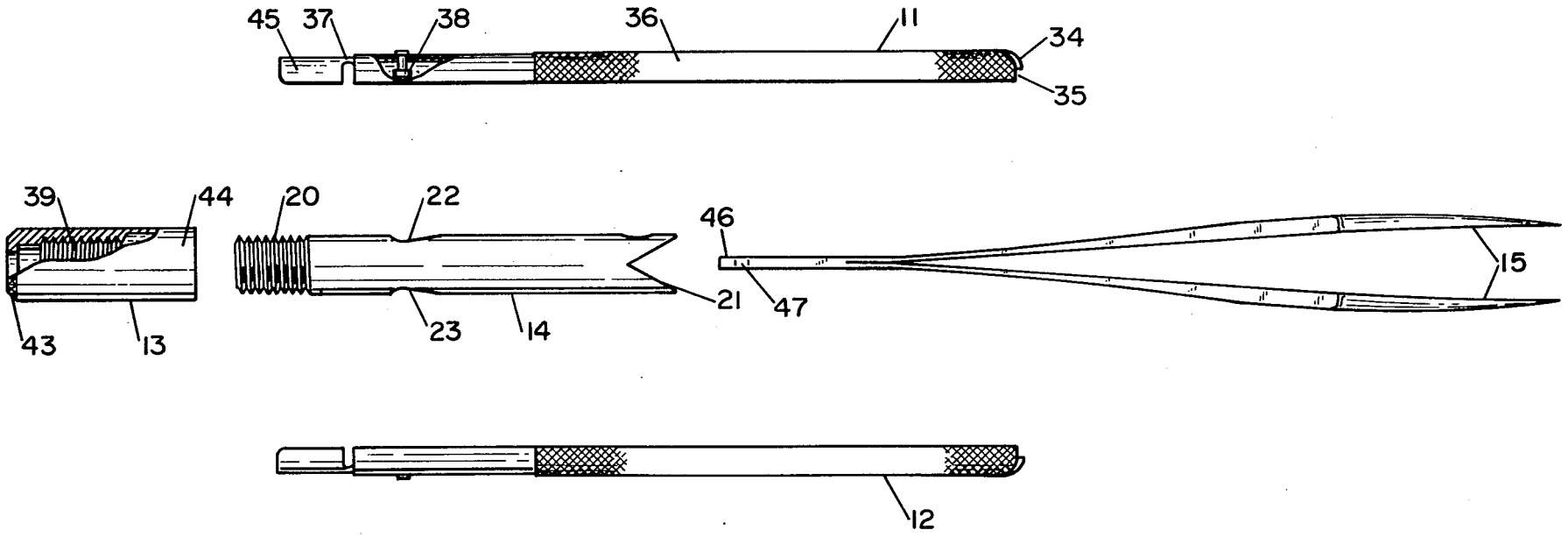
FIG. 2 is an exploded elevational view of the forceps of FIG. 1, with portions shown in section.

Referring to FIG. 2, forceps 10 is illustrated in an exploded view to more clearly show the components and their relationship to each other. Retainer body 14 is the heart of forceps 10 and is generally a hollow cylindrical stainless steel tube open at both ends and having external threads 20 at one end thereof. The opposite end of retainer body 14 is provided with a V-shaped transverse notch 21. Apertures 22 and 23 are provided through the top and bottom walls of retainer body 14 at locations radially opposite each other along a radius perpendicular to V-shaped transverse notch 21. As is shown best in FIG. 4, apertures 22 and 23 are elongated slots wherein the end of the slot nearest threads 20 is enlarged.

Figure 3:
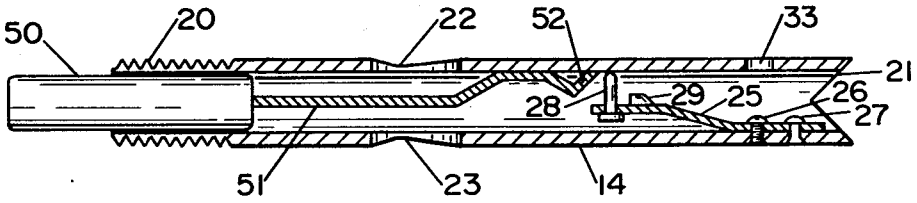
FIG. 3 is a longitudinal sectional view of the retainer body of FIG. 2, shown sectioned along a vertical plane.

As shown in FIG. 3, there is received within retainer body 14 a longitudinally oriented leaf spring 25 which is attached to the bottom wall of retainer body 14 proximate V-shaped transverse notch 21 by means of screw 26 and pin 27. Leaf spring 25 is biased to exert force upward, with pin 28 being provided to space leaf spring 25 from the top wall of retainer body 14. A small tongue 29 extends upward at an angle from leaf spring 25 and is oriented to point toward the threaded end of retainer body 14.

Figure 4:
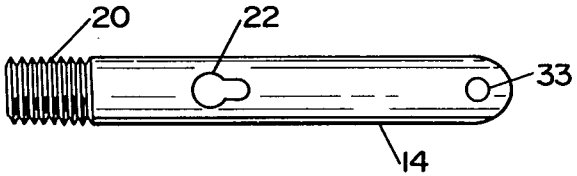
FIG. 4 is a top plan view of the retainer body of FIG. 2.

Referring to FIG. 4, aperture 33 is provided in the top wall of retainer body 14 to provide access to screw 26.

Referring again to FIG. 2, handle portion 11 is an elongated semi-cylindrical member having a closed rounded end 34 which is provided with a slot 35 for receiving forceps tips 15. A knurled portion 36 provides a non-slip surface which can be easily and securely grasped. Handle portion 11 has a narrow, thin portion 37 which provides a spring-hinge action, as described further below. A headed pin 38 extends downwardly from the inside surface of handle portion 11 and is located such that it is received through aperture 22 of retainer body 14, with the head overlying the narrow portion of aperture 22 to hold handle portion 11 in place when forceps 10 is assembled. Handle portion 12, although not specifically described herein, is substantially identical to handle portion 11.

Cap 13 is a hollow, generally cylindrical stainless steel tube open at both ends. Internal threads 39 are provided within cap 13 to engage external threads 20 of retainer body 14. Knurling 43 is provided at the rear end of cap 13 so that cap 13 can be easily grasped and screwed onto retainer body 14.

MODE OF OPERATION

Figure 6:
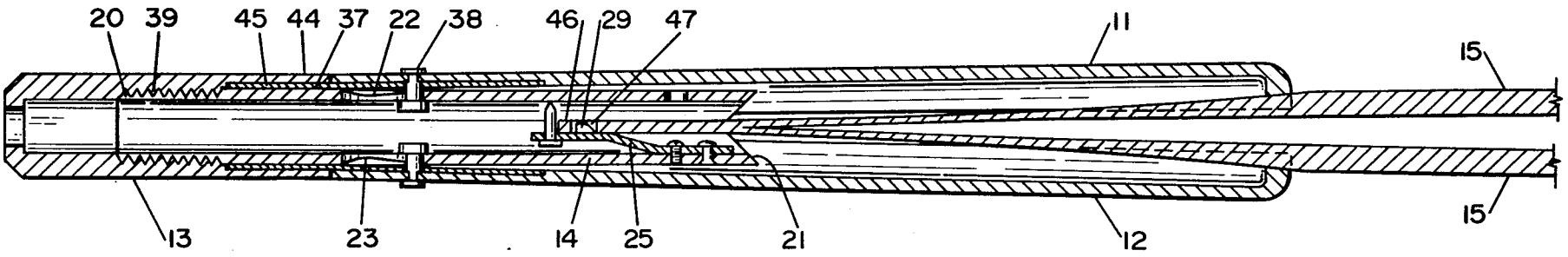
FIG. 6 is a cross-sectional view of the present invention with the forceps tips partially cutaway.

When forceps 10 is assembled, as in FIG. 1, end portion 44 of cap 13 overlies portion 45 of handle portion 11, and similarly overlies the corresponding portion of handle portion 12, to retain handle portions 11 and 12 to retainer body 14. FIG. 6 illustrates a cross section of the present invention with the tips partially cutaway.

Figure 5:
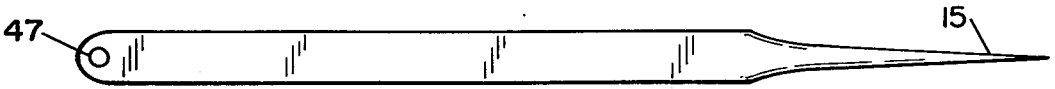
FIG. 5 is a top plan view of the forceps tips of FIG. 2.

To insert forceps tips 15 into the assembled handle formed by retainer body 14, handle portions 11 and 12, and cap 13, the end 46 of forceps tips 15 is inserted into the right open end of retainer body 14 (having V-shaped notch 21) until hole 47 (see FIG. 5) of forceps tips 15 engages tongue 29 of leaf spring 25. Forceps tips 15 are thereby retained in place. Handle portions 11 and 12 can be squeezed together to compress forceps tips 15, with the natural spring action of forceps tips 15 serving to pivot handle portions 11 and 12 apart (about spring-hinge 37) when the squeezing pressure is released.

To release forceps tips 15 from retainer body 14 for replacement, it is only necessary to compress forceps tips 15 (without squeezing handle portions 11 and 12) and pivoting forceps tips 15 so that end 46 is lifted upward and hole 47 clears tongue 29. Alternatively, a plunger 50 accessible from the rear end of cap 13 could be provided with an extensor 51 having a ramp-like portion 52 for deflecting leaf spring 25 downward as plunger 50 is pushed inward, as shown in FIG. 3.

Forceps tips 15 can not only be replaced with similar tips when damaged, but can also be replaced with alternatively configured tips if desired. For instance, it might be desirable to switch to a curved or angled tip, or to a ring tip during surgery. With the present invention, such replacements can be accomplished quickly and easily. Thus, a surgeon can have a full set of inexpensive forceps tips all utilizing a common handle.

While the preferred embodiment of the invention has been illustrated and described in some detail in the drawings and foregoing description, it is to be understood that this description is made only by way of example to set forth the best mode contemplated of carrying out the invention and not as a limitation to the scope of the invention which is pointed out in the claims below.

What is claimed is:

1. Forceps having replaceable tips comprising:

a. forceps tips, said forceps tips including a pair of side-by-side elongate configured members, each of said elongate members having including first end and a second end, said first ends of said elongate members being affixed together and including a retaining aperture, said seconds ends of said elongate members being configured as opposable tips and means biasing said second ends away with respect to each other; and, b. handle means including opposing symmetrical configured handle portions pivotally mounted about a retainer body means and including a spring biased tongue internal to said retainer body for releasably engaging said retainer aperture, a cap including means securing said handle portions about said retainer body means and means for disengaging said spring biased tongue from said retaining aperture, said handle portions and cap including knurled locations to be grasped by a person, means for receiving said forceps tips in said retainer body and for pivotally mounting about said retainer body and means on said handle means for causing a mid portion of each of said elongate members of said forceps tips to engage each of said elongate members about mid portion and to be forced towards each other in response to digital manipulation of said graspable location of said handle means, and said handle means including releasable retaining means for releasably retaining said first ends of said forceps tips.

2. In combination, forceps handle and replaceable forceps tips comprising:

a. forceps handle including opposing symmetrical handle portions and including means for pivotally mounting about a retainer body, a cap including means for securing said handle portions about said retainer body, said handle portions and said cap including knurled portions for grasping by a surgeon, means for receiving forceps tips in said retainer body, and means on said handle means for providing a mid portion of each of elongate members of said forceps tips to be forced towards each other in response to digital manipulation of said graspable locations of said handle means, said handle means also including releasable retaining means, the releasable retaining means including a retainer body having a spring biased tongue internal to said retainer body for releasably engaging said retaining aperture, each of said handle portions including a first end means for pivotally mounting within said retainer end and said second end including an internally configured lower end for engaging each of said elongate members about a mid portion thereof; and, b. each of said elongate members of said forceps tips including first ends and second ends, said first ends of said elongate members being affixed together, said second end of said elongate members being configured as opposable surgical tips and means biasing said second ends away with respect to each other, said forceps tips including a retaining aperture at said first ends for frictional engagement with said releasable retaining means whereby said forceps tips are released from said handle means by a partial revolution of said forceps tips with respect to said handle tips and pulling said forceps tips out of said retainer body means.

* * * * *